US005357586A

United States Patent [19]

Nordschow et al.

[11] Patent Number: 5,357,586

[45] Date of Patent: Oct. 18, 1994

[54] FLOW-THROUGH AIR-COOLED LOUDSPEAKER SYSTEM

[75] Inventors: David D. Nordschow, Montrose, Minn.; Terry D. Taylor, Chattanooga; Robert O. Wright, Knoxville, both of Tenn.

[73] Assignee: The Nordschow/Wright Loudspeaker Company, Chattanooga, Tenn.

[21] Appl. No.: 700,691

[22] Filed: May 16, 1991

[51] Int. Cl.[5] ..... H04R 25/00

[52] U.S. Cl. ..... 381/199; 381/159; 381/192; 181/199

[58] Field of Search ..... 381/199, 201, 202, 194, 381/197, 192, 165, 159, 158, 88, 90; 181/199, 152, 156

[56] References Cited

U.S. PATENT DOCUMENTS

| | | | |
|---|---|---|---|
| 4,387,275 | 6/1983 | Shimada | 381/194 |
| 5,042,072 | 8/1991 | Button | 381/192 |

FOREIGN PATENT DOCUMENTS

| | | | |
|---|---|---|---|
| 0177897 | 8/1986 | Japan | 381/199 |
| 0261999 | 10/1989 | Japan | 381/199 |
| 1261999 | 10/1989 | Japan | 381/199 |
| 0239099 | 10/1991 | Japan | 381/199 |

*Primary Examiner*—Curtis Kuntz
*Assistant Examiner*—Huyen D. Le
*Attorney, Agent, or Firm*—Nixon & Vanderhye

[57] ABSTRACT

The loudspeaker and enclosure are provided with aerodynamically-shaped passages providing low-pressure regions for inducing flows of air into and about the driver motor of the loudspeaker in response to vibratory movement of the speaker cone. An aerodynamically-shaped body is disposed within the pole piece to define a venturi passage for exchange of air between an interior chamber defined by a coil former and the back of the speaker. Aerodynamically-shaped openings are provided through the pole piece for inducing flow of air about the voice coil in the voice coil gap between the pole piece and permanent magnet. The speaker frame support is provided with aerodynamically-shaped openings to induce air flow into the interior chamber. In this manner, low-pressure regions established by the aerodynamic shapes induce flow of cooling air about the voice coil and pole piece in response to vibratory movement of the cone. Aerodynamic shapes are disposed in the intake and exhaust vents of the speaker enclosure to exchange air between the enclosure and atmosphere in response to vibratory movement of the speaker.

46 Claims, 4 Drawing Sheets

FIG. 2
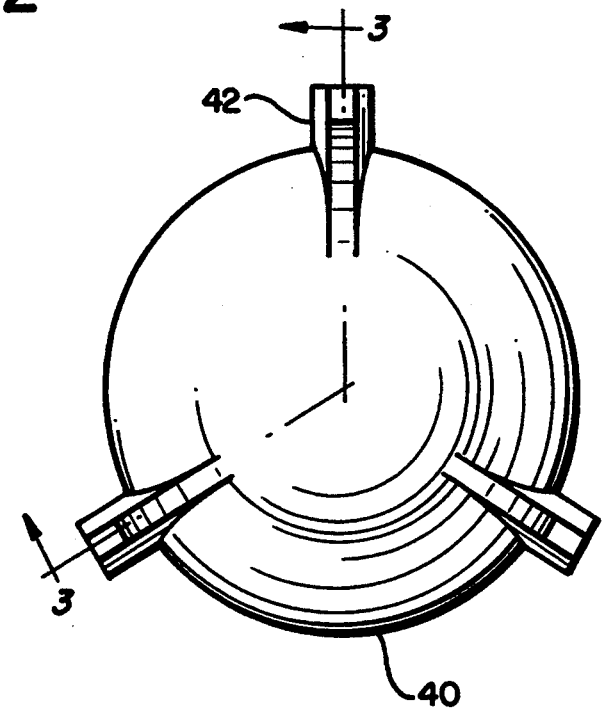
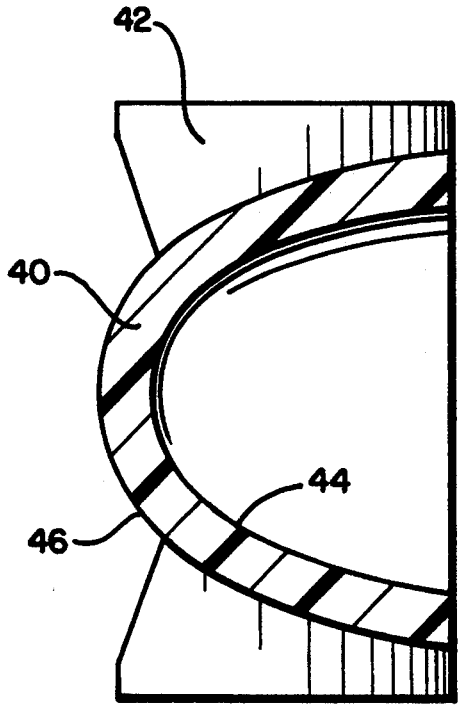
FIG. 3

FLOW-THROUGH AIR-COOLED LOUDSPEAKER SYSTEM

BACKGROUND AND SUMMARY OF THE INVENTION

The present invention relates to a loudspeaker system and particularly relates to a new and improved air cooling system for a loudspeaker system.

As well known, a loudspeaker system typically includes an acoustic transducer comprised of an electromechanical device which converts an electrical signal into acoustical energy in the form of sound waves and a box-type enclosure for directing and amplifying the sound waves produced upon application of the electrical signal. The enclosure also provides mechanical support for the loudspeaker. A loudspeaker is thus the internally mounted electromechanical component and the enclosure is the structure for mounting or enclosing the loudspeaker.

Loudspeakers typically use a driver motor comprising a winding of copper or aluminum wire about a former forming a voice coil and which coil is suspended within a magnetic field formed by the combination of a top plate, a magnet and a pole piece attached to a back plate. The loudspeaker's cone or diaphragm is attached to the voice coil former. When an electrical current is applied to the winding, the speaker cone vibrates according to the audio frequency and polarity of the applied signal. The electrical resistance of the voice coil to current flow generates heat and therefore increases the temperature within the loudspeaker and its enclosure. This resistance to current flow represents a significant part of the driver motor's impedance, and a substantial portion of the electrical input power is converted into heat rather than into acoustic energy. In high power situations, it is common for the loudspeaker coil to reach temperatures ranging from 400° to 600° F. and for the enclosure to attain internal temperatures of 150° to 200° F. The ability of the loudspeaker to tolerate heat is limited by factors such as melting points of the adhesives and materials used. The operation and performance of a speaker system is therefore inherently limited by its ability to tolerate and dissipate heat.

Power compression occurs when the temperature rises in the voice coil of the driver motor, causing the driver motor's resistance to increase, thus lowering efficiency. An increase from room temperature to 600° F. can double the resistance of the typical loudspeaker voice coil. For example, if a speaker system is designed to present an 8-ohm impedance to a 200 watt power signal, an increase in impedance to 16-ohms may be expected, with a resulting 50% decrease in the applied power When additional power is supplied to compensate for the increased resistance, additional heat is produced, again with an increase in resistance of the voice coil. At some point, any additional power input will be converted mostly into heat rather than acoustic output.

Various methods have been applied to both loudspeakers and speaker systems to improve heat dissipation, including improved conduction and convection techniques, venting, and the use of forced air cooling with fan-type devices, but no adequate, practical and affordable solution has been found to maintain desirable operating temperatures under high power conditions.

It is a common practice to dissipate the heat produced by the voice coil by venting the inside of the coil former through an opening in the center of the pole piece, and through the rear of the magnet structure, to the outside of the loudspeaker. It is also common to vent forward through the speaker diaphragm's dust cap. These methods improve heat dissipation slightly, but are not adequate under high power situations. Most of the heat transfer from the coil area is by conduction through the magnet assembly to the frame of the loudspeaker where it is radiated to the air within the enclosure. Multiple vents along the outside edge of the loudspeaker's pole piece have been placed nearer the voice coil windings to facilitate that heat transfer. All of these venting methods, however, essentially produce an oscillating column of air within the magnet structure and provide no effective cooling air flow through the driver motor.

In the case of speaker systems, venting is employed in the enclosure primarily for acoustic tuning purposes. Due to the vibrating action of the loudspeaker diaphragm in its enclosure, however, such venting produces turbulent air flow at the vent locations and thus negligible heat exchange to the outside of the enclosure. Traditional acoustic venting does little in the way of moving cooler outside air through the entire loudspeaker system.

Other methods such as cooling fans and pressurized air have been used in both loudspeakers and speaker systems, but are cumbersome, unreliable and expensive. The methods that employ electrical motors which draw from the electrical audio signal cause an unacceptable decrease in system efficiency.

In accordance with the present invention, properties of aerodynamic shaping and fluidics are used to induce the flow and exchange of air through the loudspeaker and the enclosure, thus efficiently and reliably dissipating the heat from the driver motor into the enclosure and then to the outside of the enclosure. This affords an increase in power handling, a reduction in power compression, and an increase in reliability, while simultaneously maintaining system efficiency. More particularly, the present invention provides a passive fluidic pump system with no moving parts and which is driven by the natural vibratory motion of the loudspeaker diaphragm during normal operation. On one stroke of the loudspeaker diaphragm, an intake pumping action is generated with discrete air-shaping inlet fixtures which act as single-stage pumps to create (1) multiple cooling air flow paths into the voice coil chamber of the loudspeaker and (2) flow of cooling air from ambient atmosphere into the enclosure of the speaker system. On the other stroke of the diaphragm, the outlet fixtures present multiple exhaust flow paths, causing the air to exit the drive motor and exit through the exhaust vents of the loudspeaker system.

The fluidic pumping system is comprised of several intake and exhaust pumps. The intake pumps operate, for example, during forward motion of the loudspeaker diaphragm; the exhaust pumps operate during rearward motion of the diaphragm. In one embodiment of the present invention, a first intake pump is located on the loudspeaker frame base. Due to the aerodynamic shape of the openings, air flow is induced into the voice coil chamber of the loudspeaker on the forward stroke of the diaphragm. Heat from the voice coil is transferred by conduction through the walls of the pole piece and into the air inside the voice coil chamber. A second aerodynamically-shaped intake pump is located adjacent the junction of the motor structure's back plate and the rear of the pole piece and includes aerodynamically-shaped openings through the pole piece. This provides a flow path which induces air flow through openings in the pole piece, into the voice coil gap, under the spider assembly, through multiple openings in the voice coil former, and into the voice coil chamber on the same forward stroke of the diaphragm. Simultaneously, a third aerodynamically-shaped intake pump, located in a wall of the speaker system enclosure, also presents a flow path, causing fresh cool ambient air from outside the enclosure to be drawn into the enclosure to circulate around the loudspeaker.

In this same embodiment, a first exhaust pump is located at the rear of the loudspeaker, and includes a member having an aerodynamically-shaped surface mounted within the driver motor pole piece, creating a back chamber between the pole piece and the member. On the rearward stroke of the diaphragm, a low-pressure region is created in this back chamber by the shaped surface and air inside the voice coil chamber is drawn rearwardly through the driver motor to the outside of the loudspeaker into the enclosure. A second exhaust pump includes aerodynamically-shaped openings defining a flow path which, on the rearward stroke of the diaphragm, circulates air through the voice coil gap and into the exhaust flow path of the first exhaust pump. On the same rearward diaphragm stroke, a third aerodynamically-shaped exhaust pump located on a wall of the speaker system enclosure provides a flow path for flowing heated air within the enclosure to the outside of the enclosure. The action of the intake pumps on the forward diaphragm stroke, in tandem with the action of the exhaust pumps on the rearward diaphragm stroke, will in a full cycle or a repetition of cycles cause air to flow into the speaker system enclosure at a low volumetric flow rate, through the drive motor of the loudspeaker, and then out of the speaker system enclosure. The resulting exchange of air in both the enclosure and the loudspeaker provides sufficient air exchange and therefore heat exchange to significantly reduce operating temperatures, therefore increasing power handling and reliability, and reducing power compression while maintaining loudspeaker efficiency. That is, as a result of the aerodynamic shape of the pumps including the member having the aerodynamically-shaped surface within the drive motor pole piece, low-pressure regions are provided. Thus, in the loudspeaker, the aerodynamically-shaped surface of the member defines a low pressure region for inducing a linear rectified flow of air between the voice coil chamber and a cavity about such surface without substantial reverse flow of air therebetween in response to vibratory movement of the speaker cone. With respect to the speaker enclosure, the aerodynamically-shaped surface of the vent member defines a low pressure region of increasing cross-sectional area which induces a linear rectified flow of air through the vent and between the enclosure and ambient air without substantial reverse flow of air therebetween in response to vibratory movement of the speaker cone.

The heat generated by the driver motor is transferred from the coil to the pole piece which acts as a heat sink. Thus, it is significant to not only cool the voice coil per se, but to provide cooling air flowing in and about the pole piece. The convection currents afforded by the intake and exhaust pumps flow cooling air along the outside of the voice coil and along interior portions of the pole piece during both strokes of the speaker cone. Consequently, convective cooling air flow is provided adjacent those areas most capable of heat transfer.

In the previously described embodiment of the present invention, the aerodynamic shapes of the second inlet and exhaust openings through the pole piece are reversed from one another on opposite sides of the pole piece. This creates a convection cooling air flow current from one side of the voice coil to the other side. That is, cooling air flow from within the enclosure, on the intake stroke of the diaphragm, may enter along one side of the pole piece through the aerodynamically-shaped opening to flow through the gap into the chamber exterior to the voice coil and then into the voice coil chamber through the voice coil apertures. On the exhaust stroke, the cooling air flows from the voice coil chamber, through the exterior chamber and voice coil gap and through the oppositely aerodynamically-shaped openings of the pole piece along the opposite side of the loudspeaker. In this manner, the voice coil, the pole piece and the interior chamber are in constant contact with moving convective cooling air currents.

In another embodiment hereof, the previously described second intake opening can be reversed in aerodynamic shape to provide exhaust openings whereby the cooling air intake is through only the openings in the frame and the exhaust is through the annular gap and all openings of the pole piece. The reverse configuration may also be provided where the second openings are all aerodynamically-shaped to comprise intake openings whereby the cooling air exhaust flows solely through the annular gap.

Also, the pumping action may be reversed with virtually no degradation in performance, by reversing the orientation of all the pumps. Any single pump or combination of pumps will operate in essentially the same manner, with the only noticeable difference being the level of efficiency in the pumping action.

With respect to the enclosure, the intake and exhaust ports act in a dual role, providing the cooling function in addition to acoustic tuning. For purposes of acoustically tuning the speaker system, the surface area and the depth of the venting port determine the tuned frequency of the speaker system, with the side benefit of effecting a small amount of air exchange within the enclosure. Traditional venting techniques utilize straight cuts through the enclosure wall or walls in a variety of cutout shapes, resulting in air turbulence on both the forward and rearward strokes of the loudspeaker diaphragm and therefore restricting air flow. The use of aerodynamically-shaped inlet and outlet fixtures mounted on a wall or walls of the enclosure in accordance with the present invention, raises the acoustical efficiency of the speaker system tuning and, in addition, facilitates the exchange of air between the interior of the enclosure and ambient atmosphere.

In a preferred embodiment according to the present invention, there is provided a loudspeaker comprising a speaker cone, a generally annular electrical winding and former therefor defining an interior air chamber and attached to the speaker cone for vibrating the latter, a generally annular pole piece arranged substantially coaxially of the voice coil and a permanent magnet cooperable with the pole piece for driving the speaker cone in response to an electrical signal applied to the coil, a cooling system for the loudspeaker including a member having an aerodynamically-shaped surface disposed to define an air gap with the pole piece, the air gap lying in communication with the chamber, the surface being aerodynamically-shaped to define with the pole piece a cavity having an increasing cross-sectional area in a direction away from the gap and thereby defining a low-pressure region for inducing a flow of air between the interior chamber and the cavity in response to vibratory movement of the speaker cone.

In a further improved embodiment according to the present invention, there is provided a loudspeaker comprising a speaker cone, a generally annular voice coil and former therefor defining an interior air chamber and attached to the speaker cone for vibrating the latter, a generally annular pole piece arranged substantially coaxially of the voice coil and a permanent magnet cooperable with the pole piece for driving the speaker cone in response to an electrical signal applied to the coil, a cooling system for the coil including a speaker frame having a frame support and at least one opening through the frame support, a spider connecting the speaker frame and the cone one to the other and defining an exterior chamber about the voice coil former, a plurality of apertures through the former affording communication between the interior and exterior chambers, the one frame support opening being larger in cross-sectional dimension in a radially inward or outward direction to define a low-pressure region adjacent the larger dimensioned side of the one opening to induce flow of cooling air between the low-pressure region and the interior chamber and about the coil in response to vibratory movement of the cone.

In a further preferred embodiment according to the present invention, there is provided a loudspeaker comprising a speaker cone, a generally annular voice coil and former therefor defining an interior air chamber and attached to the speaker cone for vibrating the latter, a generally annular pole piece arranged substantially coaxially of the voice coil and a permanent magnet, the pole piece and permanent magnet defining a gap for receiving the voice coil therebetween, the permanent magnet being cooperable with the pole piece for driving the speaker cone in response to an electrical signal applied to the coil, the pole piece having an internal cavity, a cooling system for the loudspeaker including a speaker frame and a spider connecting the speaker frame and the cone one to the other and defining an exterior chamber about the voice coil former, a plurality of aerodynamically-shaped openings spaced circumferentially one from the other about the pole piece affording communication between the exterior chamber and the cavity through the voice coil gap, the aerodynamically-shaped openings providing a low-pressure region on one side thereof for inducing a flow of cooling air between the cavity and the exterior chamber in response to vibratory movement of the cone.

In a further preferred embodiment according to the present invention, there is provided a loudspeaker system comprising an enclosure, a speaker cone mounted in the enclosure, means for driving the speaker cone to produce audible sound waves and a cooling system for the loudspeaker system including at least one vent for exchanging air within the enclosure and ambient air outside the enclosure, the one vent including a member having an aerodynamically-shaped surface defining a region of increasing cross-sectional area and a low pressure region for inducing air flow through the one vent and between the enclosure and ambient air in response to vibratory movement of the speaker cone.

Accordingly, it is a primary object of the present invention to provide a novel and improved air cooling system for a loudspeaker system which relies on aerodynamically-shaped non-movable parts responsive solely to the vibratory motion of the speaker cone to induce convective cooling air flows through the loudspeaker and exchange air within the loudspeaker enclosure and ambient atmosphere.

These and further objects and advantages of the present invention will become more apparent upon reference to the following specification, appended claims and drawings.

BRIEF DESCRIPTION OF THE DRAWING FIGURES

FIG. 2 is an enlarged rear elevational view of an aerodynamically-shaped member disposed in the pole piece and affording, with adjacent parts, an air pumping action;

FIG. 3 is a cross-sectional view thereof taken generally about on line 3—3 in FIG. 2;

Figure 4A:
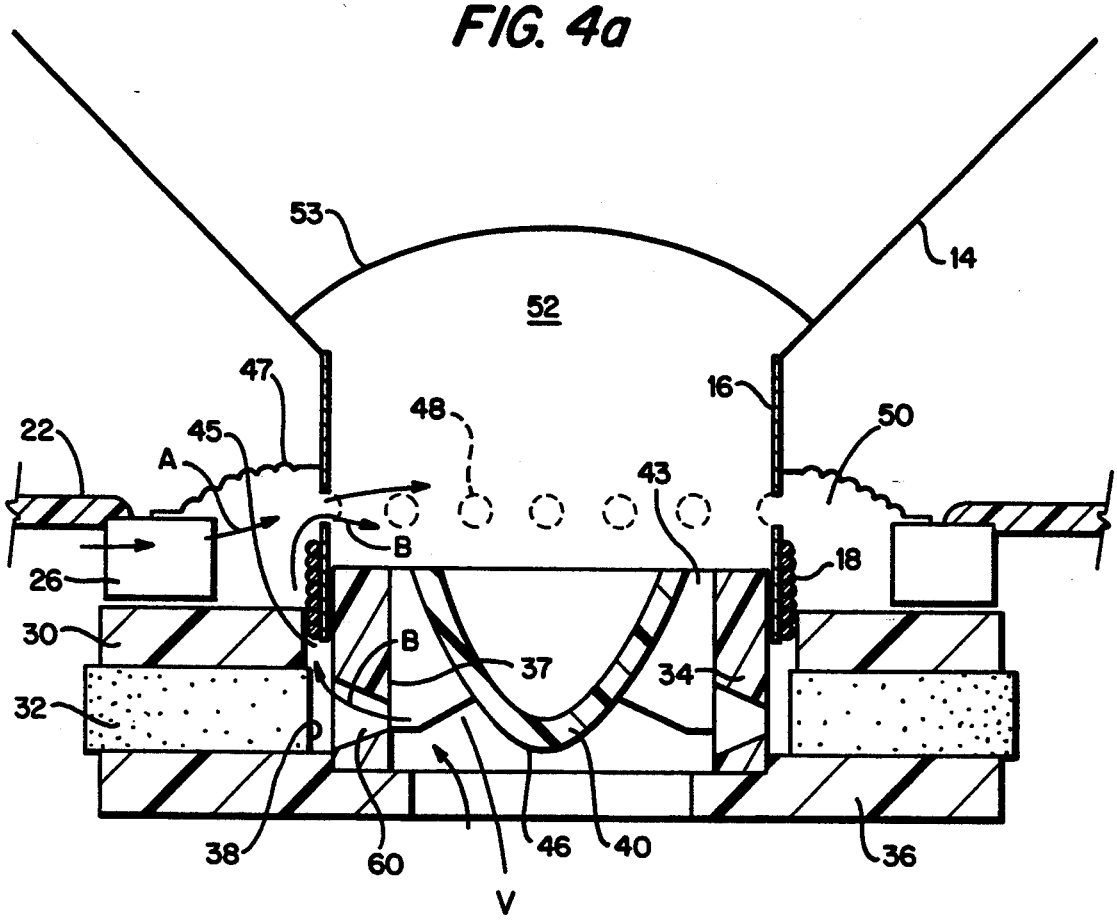
Figure 4B:
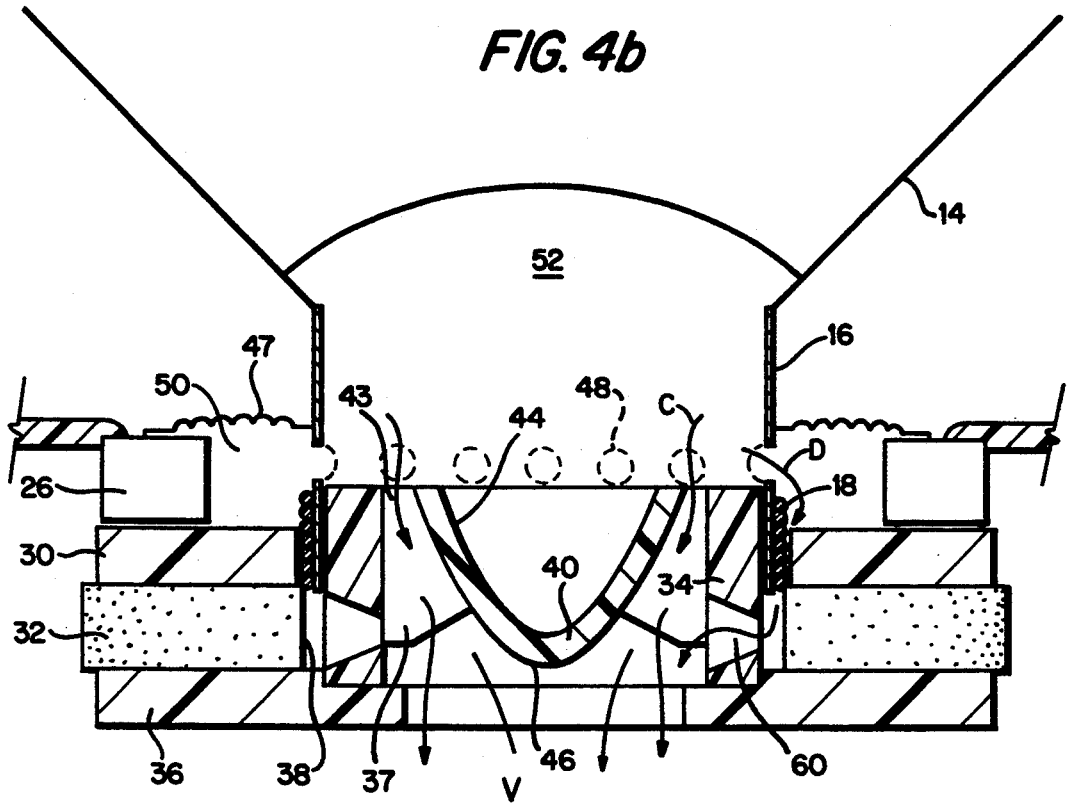
Figure 5:
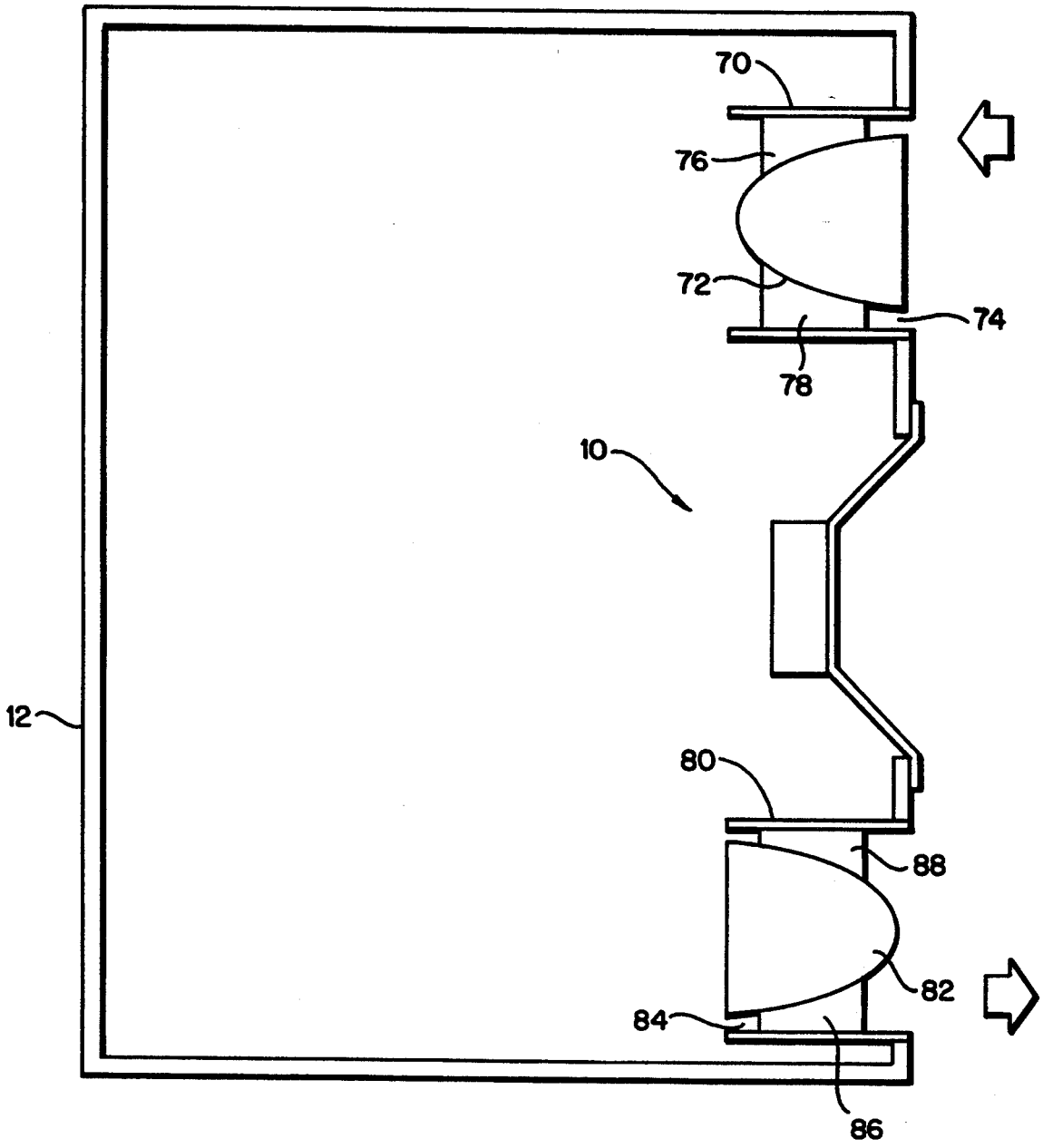

FIGS. 4*a* and 4*b* are enlarged fragmentary cross-sectional views of a loudspeaker according to the present invention, exaggerated to illustrate the intake and exhaust strokes of the speaker cone and its relation to the convective cooling air flows through the speaker system; and FIG. 5 is a schematic vertical cross-sectional view through an enclosure housing the loudspeaker hereof and illustrating the aerodynamically-shaped vents through the enclosure.

DETAILED DESCRIPTION OF THE DRAWING FIGURES

Reference will now be made in detail to a present preferred embodiment of the invention, an example of which is illustrated in the accompanying drawings.

Figure 1:
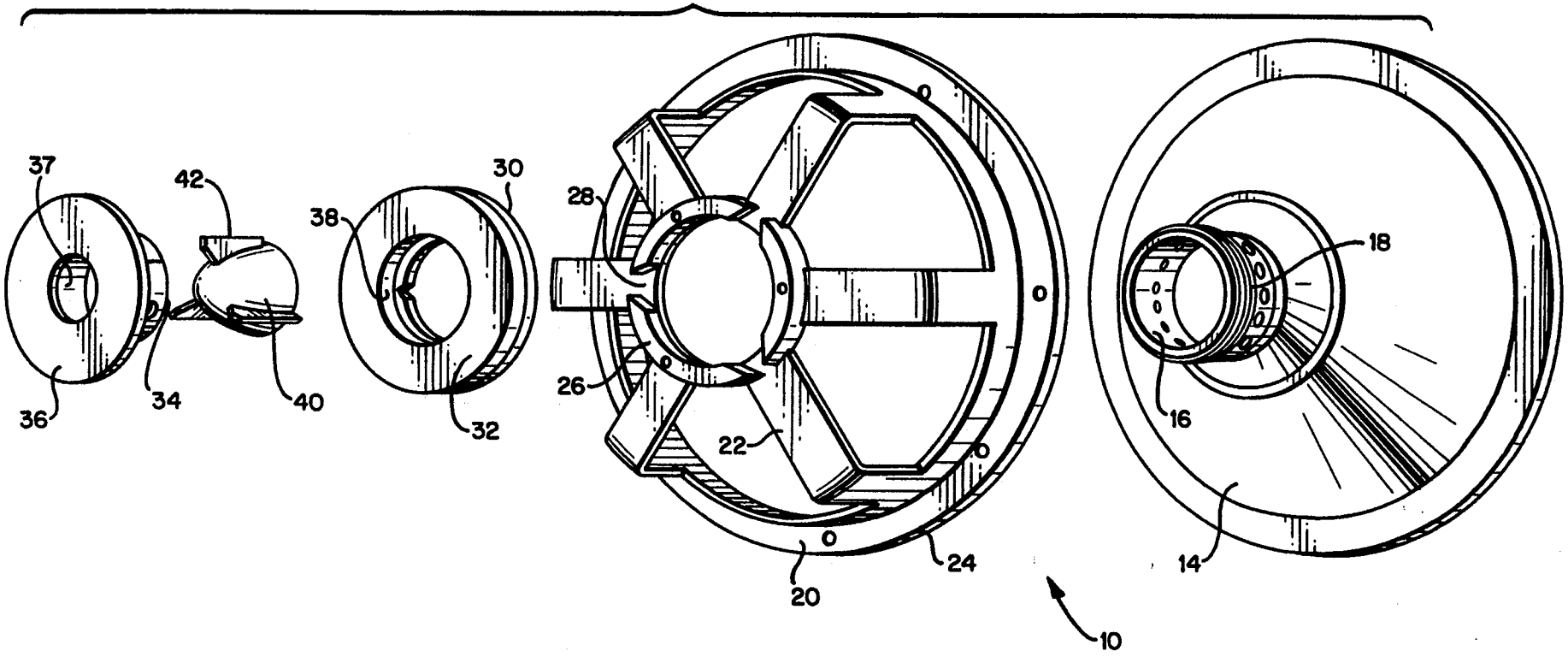
FIG. 1 is a perspective view with parts broken away from one another of a loudspeaker constructed in accordance with the present invention.

Referring now to the drawings, particularly to FIGS. 1 and 5, there is illustrated a loudspeaker, constructed in accordance with the present invention and generally designated 10, disposed in an enclosure or cabinet 12 whereby loudspeaker 10 and enclosure 12 define a loudspeaker system. It will be appreciated that one or more loudspeakers may be disposed in the enclosure and that the illustration of but one loudspeaker is exemplary only. It will also be appreciated that an electrical signal is provided the voice coil of the loudspeaker whereby the electrical energy is converted into acoustical energy in the form of sound waves.

Referring now particularly to FIG. 1, loudspeaker 10 includes a speaker cone or diaphragm 14 and an annular former 16, about which an electrical winding 18 is formed thereby providing a voice coil. The winding 18 is connected to suitable leads, not shown, to an electrical input signal, also not shown. Any other winding may be used, e.g., a stepper motor. The winding 18 will be hereinafter referred to as voice coil 18. Speaker cone 14 is mounted in a frame 20 having a plurality of radially extending frame members 22 supporting an annular speaker cone support ring 24. The radial inner ends of speaker frame members 22 are connected to a generally annular frame support 26 having a plurality of circumferentially-shaped, radially extending openings 28, described further hereinafter.

Axially, inwardly of the frame support 26 is a top or front plate 30 overlying an annular permanent magnet 32. A generally annular pole piece 34 is carried on a backplate 36. Pole piece 34 is receivable in the central opening 38 of permanent magnet 32 and top plate 30.

In accordance with the present invention, there is disposed in the central cylindrical opening 37 of pole piece 34 an aerodynamically-shaped body 40. As illustrated, body 40 preferably comprises a thin-wall structure having an aerodynamically-shaped surface, in this case, a paraboloid of revolution. Along the outer surface of aerodynamically-shaped body 40 are provided circumferentially-spaced spacers 42 for spacing body 40 coaxially within the cylindrical opening 37 through pole piece 34. Thus, both the forward and rear surfaces 44 and 46 facing the forward and rear ends of the loudspeaker, respectively, are ellipsoids of revolution, with the outer surface 46 being spaced from the cylindrical interior surface 37 of pole piece 34 by spacers 42 to define an annular air gap 43 therewith. It will be appreciated that other aerodynamic shapes may be used, e.g., exponential hyperbolic and parabolic-shaped surfaces. Gap 43, i.e., the cross-sectional area of the gap, enlarges in the rearward direction of the speaker to define an enlarged cavity or volume V and hence a low-pressure region, spaced rearwardly of the annular air gap 43.

Referring again to FIGS. 4*a* and 4*b*, it will be appreciated that voice coil former 16 and voice coil 18 are disposed in the annular voice coil gap 45 between annular pole piece 34 and permanent magnet structure 30 and 32. A flexible spider 47 interconnects voice coil former 16 and frame support 26. As illustrated, voice coil former 16 also has a plurality of apertures 48 circumferentially spaced thereabout and opening into an annular chamber 50 exterior to the interior voice coil chamber 52. A dust cap 53 overlies the distal end of voice coil former 16 and is secured to cone 14.

The loudspeaker hereof operates in a conventional fashion. That is, upon application of an electrical signal to voice coil 18, voice coil 18 and former 16 vibrate in an axial direction, causing speaker cone 14 to similarly vibrate, hence converting electrical energy into acoustical energy in the form of sound waves. As noted previously, the electrical resistance of voice coil 18 to current flow generates heat and increases the temperature within the loudspeaker and the enclosure. In accordance with the present invention, portions of the structure of speaker 10 and enclosure 12 have been aerodynamically shaped to induce flow and exchange of air between the loudspeaker and the enclosure and between the enclosure and ambient atmosphere, thus efficiently and reliably dissipating heat from the loudspeaker into the enclosure and then from the enclosure to the ambient atmosphere. It will also be appreciated that, because of the presence of pole piece 34, heat generated by the electrical energy passing through voice coil 18 is transferred to and collected by pole piece 34, which serves in part as a heat sink, and also collects in interior chamber 52. Thus, it is important not only to air-cool the voice coil per se, but also pole piece 34 and exchange cooling air for heated air in interior chamber 52 in order to reduce the temperature of the loudspeaker.

To accomplish the foregoing, the present invention provides static, aerodynamically-shaped regions and passages such that the vibratory action of speaker cone 14 and dust cover 53 induces an exchange of air through the loudspeaker with cooling air from within the enclosure, as well as an exchange of heated air within the enclosure and ambient air. Referring now to FIG. 4*a*, it will be appreciated that the shape of aerodynamic body 40 provides an annular air gap 43 adjacent pole piece 34 and the outer end of body 40. In the illustrated embodiment, gap 43 increases in cross-sectional area in an axially rearward direction to define a low-pressure region at V. A venturi-type nozzle is thus formed. Additionally, and referring to FIGS. 1 and 4*a*, annular frame support 26 has a plurality of radially extending openings 28 which, in the illustrated embodiment, are shaped to increase in cross-sectional area in a radially inward direction to define a low-pressure region radially inwardly thereof. That is, the walls defining the openings 28 diverge one from the other in a radially inward direction to provide a venturi nozzle. This defines a low-pressure region inwardly of openings 28. Additionally, and referring to FIG. 4*a*, a plurality of openings 60 are circumferentially disposed about pole piece 34, providing for communication between the volume V and the voice coil gap 45. As illustrated in FIG. 4*a*, gap 45 lies in communication with the second or exterior chamber 50 and hence in communication with the interior chamber 52 of voice coil former 16 through apertures As illustrated in FIG. 4*a*, the openings 60 are aerodynamically shaped to provide a venturi-type nozzle.

In the illustrated embodiment hereof, one or more of openings 60 on one side of pole piece 34 has walls diverging one from the other in a radially outward direction to define a low-pressure region in the voice coil gap 45. One or more of openings 60 on the opposite side of the pole piece have walls diverging one from the other in a radially inward direction to provide a low-pressure region in volume V. In the particular illustrated embodiment, these openings on opposite sides of the pole piece which are aerodynamically-shaped in a reverse configuration from one another provide a convective cooling air flow from side to side through the loudspeaker, as will become clear. Generally, however, it is the cooperation of the low-pressure regions on the enlarged sides of the venturi-type nozzles provided by the aerodynamic shapes of these various cooling air flow passages which affords the enhanced cooling effect provided the loudspeaker according to the present invention, as will become more clear from the ensuing description.

The foregoing description of the aerodynamically-shaped passages refers to an exemplary embodiment of the invention. It will be appreciated that all of the aerodynamic passages can be reversed in configuration to locate the low-pressure regions on the opposite sides than described above. The cooling effects will be substantially similar to those obtained in the illustrated embodiment but will be in response to vibratory movement of the speaker cone in the opposite directions, as described below. Additionally, all of the openings 60 about pole piece 34 may diverge radially inwardly or outwardly. Either configuration of openings 60 or their reverse configuration along opposite sides of the pole piece as specifically described above may be used with either configuration of the aerodynamically-shaped body 40 and openings 28 through support 26.

Referring now to FIG. 5, speaker enclosure 12 has a pair of vent openings having similar aerodynamically-shaped bodies as body 40. For example, the intake opening for transferring ambient air into speaker enclosure 12 has an aerodynamically-shaped body 72 defining an annular air gap 74 adjacent the outer wall of enclosure 12. Body 72 therefore defines a volume 76 which increases in cross-sectional area in a direction toward the interior of enclosure 12 thereby defining a low-pressure region for inducing flow of cooling air through vent 70 into the interior of the enclosure. Spacers 78 are employed to locate the body 72 in vent opening 70.

The exhaust vent opening 80 is essentially the reverse configuration of the vent inlet opening 70. In vent 80, the aerodynamically-shaped body 82 defines an annular gap 84 and a volume 86 which increases in annular cross-sectional area in a direction outwardly of the enclosure to define a low-pressure region for inducing flow of heated air from within the enclosure into the ambient atmosphere. Spacers 88 are similarly employed to locate body 82 in vent opening 70.

In operation, and referring to FIG. 4*a*, wherein cone 14 is illustrated moving outwardly away from the base or magnet structure of loudspeaker 10, air from within enclosure 12 is induced by the outward movement of cone 14 and the low-pressure region radially inwardly of openings 28 to flow from within enclosure 12 through openings 28 to the exterior chamber 50 and then through apertures 48 into interior chamber 52 as indicated by arrows A. Simultaneously, outward movement of cone 14, causes air from within enclosure 12 to flow through openings 60 on the side of pole piece 34 wherein the low-pressure region is established in the voice coil gap 45. Thus, as indicated by the arrows B, air flows from within enclosure 12, through openings 60 into voice coil gap 45, about coil 18, into exterior chamber 50 and through apertures 48 into interior chamber 52. Because the openings 60 on the opposite side of pole piece 34 and annular air gap 43 are opposite in aerodynamic configuration, substantially no flow occurs through those openings. It will be appreciated therefore that the low-pressure regions induce the flow of air from within enclosure 12 into and about the loudspeaker structure. Simultaneously, ambient air is induced by aerodynamically-shaped body 72 for flow into enclosure 12 through inlet vent opening 70.

Referring to FIG. 4*b*, which illustrates the reverse stroke of cone 14, i.e., a movement toward the base structure of the loudspeaker, the low-pressure region V induces flow of air from interior chamber 52 through annular air gap 43 into the low-pressure region and out the annular opening of back plate 36 into enclosure 12 as indicated by the arrows C. Simultaneously, because of the reverse aerodynamic shape of the openings 60, for example, on the right side, as illustrated in FIG. 4*b*, the low-pressure region established thereby induces flow from interior chamber 52 through apertures 48 into exterior chamber 50 and through the voice coil gap 45 and openings 60 (on the right side of the drawing figure), into the volume V for flow through the central opening in back plate 36 into the enclosure 12, as indicated by the arrows D. Simultaneously, heated air from within enclosure 12 is induced by aerodynamically-shaped body 82 for flow from enclosure 12 through outlet vent opening 80 to atmosphere.

By the foregoing construction, it will be appreciated that on both intake and exhaust flows, cooling air is supplied about the voice coil 18 and into the interior volume 52 where heat collects. Additionally, the convective flow of cooling air passes through the interior of the pole piece during the intake stroke. On the exhaust stroke, the air flows similarly within pole piece 34 and about winding 18 on the opposite side of the pole piece. Consequently, there is a flow of cooling air both during intake and exhaust strokes which passes from side to side of the loudspeaker and through the drive motor to continually effect cooling thereof.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A loudspeaker comprising:

a speaker cone;

a generally annular electrical winding forming a voice coil and former therefor defining an interior air chamber and attached to said speaker cone for vibrating the latter;

a generally annular pole piece arranged substantially coaxially of said voice coil and a permanent magnet cooperable with said pole piece for driving said speaker cone in response to an electrical signal applied to said coil; and a cooling system for the loudspeaker including a member having an aerodynamically-shaped surface disposed to define an air gap with said pole piece, said air gap lying in communication with said chamber, said surface being aerodynamically-shaped to define with said pole piece a cavity having an increasing cross-sectional area in a direction away from said gap and thereby defining a low-pressure region for inducing a linear rectified flow of air between said interior chamber and said cavity without substantial reverse flow of air therebetween in response to vibratory movement of said speaker cone.

2. A loudspeaker according to claim 1 including a speaker frame and a spider connecting said speaker frame and said cone one to the other and defining an exterior chamber about said voice coil former, a passive air pump carried by said pole piece including a plurality of aerodynamically-shaped openings spaced circumferentially one from the other about said pole piece with each opening being larger in cross-sectional dimension on one side of said opening than on the opposite side of said opening to define low-pressure regions on said one side of said pole piece openings for inducing a flow of cooling air through said pole piece openings between said exterior chamber and said cavity in response to vibratory movement of the cone.

3. A loudspeaker according to claim 2 wherein one of said low-pressure regions defined by at least one of said openings about said pole piece lies on a side of said pole piece remote from said cavity.

4. A loudspeaker according to claim 2 wherein one of said low-pressure regions defined by at least one of said openings about said pole piece lies on a side of said pole piece remote from said exterior chamber.

5. A loudspeaker according to claim 2 wherein one of said low-pressure regions defined by at least one of said openings about said pole piece lies on a side of said pole piece remote from said cavity and at least another of said low-pressure regions defined by another of said openings about said pole piece lies on a side of said pole piece remote from said exterior chamber thereby to induce a flow of air from one side of said loudspeaker to its opposite side.

6. A loudspeaker according to claim 2 wherein said speaker frame has a frame support, a plurality of apertures through said former affording communication between said interior and exterior chambers, a passive air pump carried by said frame support including at least one opening through said frame support, said one support frame opening being aerodynamically-shaped with a cross-sectional dimension on one side thereof larger than the cross-section of said one opening on the opposite side thereof to define a low-pressure region adjacent said one side thereof and said exterior chamber, at least one of said low-pressure regions defined by one of said pole piece openings being located externally of said pole piece;

whereby cooling air is induced to flow (i) through said one frame opening into said exterior chamber and through the apertures in said former into said interior chamber and (ii) through said one opening in said pole piece into said exterior chamber for flow through said apertures in the former into said interior chamber, in response to vibratory movement of said speaker cone in one direction.

7. A loudspeaker according to claim 1 including an enclosure for said speaker, said enclosure having at least one inlet vent for exchanging air within said enclosure and ambient air outside said enclosure, said one vent including a member having an aerodynamically-shaped surface defining a region of increasing cross-sectional area in the direction of air flow entering said enclosure through said one vent for inducing air flow into said enclosure in response to vibratory movement of said speaker cone.

8. A loudspeaker according to claim 1 including an enclosure for said speaker, said enclosure having at least one exhaust vent for exchanging air within said enclosure and ambient air outside said enclosure, said one vent including a member having an aerodynamically-shaped surface defining a region of increasing cross-sectional area in the direction of air flow exhausting from said enclosure to ambient air for inducing outflow of air from said enclosure to ambient in response to vibratory movement of said speaker cone.

9. A loudspeaker comprising:

a speaker cone;

a generally annular voice coil and former therefor defining an interior air chamber and attached to said speaker cone for vibrating the latter;

a generally annular pole piece arranged substantially coaxially of said voice coil and a permanent magnet cooperable with said pole piece for driving said speaker cone in response to an electrical signal applied to said coil; and a cooling system for the coil including a speaker frame having a frame support, a spider connecting said speaker frame and said cone one to the other and defining an exterior chamber about said voice coil former, a plurality of apertures through said former affording communication between said interior and exterior chambers, a passive air pump carried by said frame support including at least one opening through said frame support, said one frame support opening being larger in cross-sectional dimension on one side of said frame support than on the opposite side of said frame support to define a low-pressure region adjacent the larger dimensioned side of said one opening to induce flow of and thereby pump cooling air unidirectionally between said low-pressure region and said interior chamber and about said coil in response to vibratory movement of said cone.

10. A loudspeaker according to claim 9 wherein said pole piece has an internal cavity, a passive air pump carried by said pole piece including a plurality of aerodynamically-shaped openings spaced circumferentially one from the other about said pole piece affording communication between said exterior chamber and said cavity, each said pole piece openings being larger in cross-sectional dimension on one side of said opening than on the opposite side of said pole piece opening to define a low-pressure region on one side thereof for inducing a flow of cooling air between said exterior chamber and said cavity.

11. A loudspeaker according to claim 10 wherein at least one of said openings about said pole piece provides said low-pressure region on the side of said pole piece remote from said cavity.

12. A loudspeaker according to claim 10 wherein at least one of said openings about said pole piece provides said low-pressure region on the side of said pole piece remote from said exterior chamber.

13. A loudspeaker according to claim 10 wherein at least one of said openings about said pole piece provides said low-pressure region on the side of said pole piece remote from said cavity and at least another of said openings about said pole piece provides said low-pressure region on the side thereof remote from said exterior chamber.

14. A loudspeaker according to claim 10 wherein at least one of said openings through said pole piece provides said low-pressure region externally of said pole piece whereby cooling air is induced to flow (i) through said one frame opening into said exterior chamber and through the apertures in said former into said interior chamber and (ii) through said one opening in said pole piece into said exterior chamber for flow through said apertures in the former into said interior chamber, in response to vibratory movement of said speaker cone in one direction.

15. A loudspeaker according to claim 9 including an enclosure for said speaker, said enclosure having at least one inlet vent for exchanging air within said enclosure and ambient air outside said enclosure, said one vent including a member having an aerodynamically-shaped surface defining a region of increasing cross-sectional area in the direction of air flow entering said enclosure through said one vent for inducing air flow into said enclosure in response to vibratory movement of said speaker cone.

16. A loudspeaker according to claim 9 including an enclosure for said speaker, said enclosure having at least one exhaust vent for exchanging air within said enclosure and ambient air outside said enclosure, said one vent including a member having an aerodynamically-shaped surface defining a region of increasing cross-sectional area in the direction of air flow exhausting from said enclosure to ambient air for inducing overflow of air from said enclosure to ambient in response to vibratory movement of said speaker cone.

17. A loudspeaker according to claim 9 including an enclosure for said speaker, said enclosure having a pair of vents for exchanging air within said enclosure and ambient air outside said enclosure, one of said vents including a member having an aerodynamically-shaped surface defining a region of increasing cross-sectional area in the direction of air flow entering said enclosure, the other of said vents including a member having an aerodynamically-shaped surface defining a region of increasing cross-sectional area in the direction of air flow exhausting from said enclosure to ambient air whereby said intake and exhaust vents serve to exchange air in said enclosure and ambient air in response to vibratory movement of said speaker cone.

18. A loudspeaker comprising:

a speaker cone;

a generally annular voice coil and former therefor defining an interior air chamber and attached to said speaker cone for vibrating the latter;

a generally annular pole piece arranged substantially coaxially of said voice coil and a permanent magnet, said pole piece and permanent magnet defining a gap for receiving said voice coil therebetween, said permanent magnet being cooperable with said pole piece for driving said speaker cone in response to an electrical signal applied to said coil, said pole piece having an internal cavity; and a cooling system for said loudspeaker including a speaker frame and a spider connecting said speaker frame and said cone one to the other and defining an exterior chamber about said voice coil former, a passive air pump carried by said pole piece including a plurality of aerodynamically-shaped openings spaced circumferentially one from the other about said pole piece affording communication between said exterior chamber and said cavity through said voice coil gap, said aerodynamically-shaped openings being larger in cross-sectional dimension on one side of said pole piece than on the opposite side of said pole piece providing a low-pressure region on said one side thereof for inducing a linear rectified flow of cooling air between said cavity and said exterior chamber without substantial reverse flow of air therebetween in response to vibratory movement of said cone.

19. A loudspeaker according to claim 18 including an enclosure for said speaker, said enclosure having at least one inlet vent for exchanging air within said enclosure and ambient air outside said enclosure, said one vent including a member having an aerodynamically-shaped surface defining a region of increasing cross-sectional area in the direction of air flow entering said enclosure through said one vent for inducing air flow into said enclosure in response to vibratory movement of said speaker cone.

20. A loudspeaker according to claim 18 including an enclosure for said speaker, said enclosure having at least one exhaust vent for exchanging air within said enclosure and ambient air outside said enclosure, said one vent including a member having an aerodynamically-shaped surface defining a region of increasing cross-sectional area in the direction of air flow exhausting from said enclosure to ambient air for inducing overflow of air from said enclosure to ambient in response to vibratory movement of said speaker cone.

21. A loudspeaker comprising:

an enclosure;

a speaker cone mounted in said enclosure;

means for driving said speaker cone to produce audible sound waves; and a cooling system for the loudspeaker system including at least one vent for exchanging air within said enclosure and ambient air outside said enclosure, said one vent including a member having an aerodynamically-shaped surface defining a region of increasing cross-sectional area and a low pressure region for inducing a linear rectified flow of air through said one vent and between said enclosure and ambient air without substantial reverse flow of air therebetween in response to vibratory movement of said speaker cone.

22. A loudspeaker system according to claim 21 wherein said one vent comprises an inlet vent for inducing a flow of air into said enclosure.

23. A loudspeaker system according to claim 22 wherein said one vent comprises an exhaust vent for inducing a flow of air from said enclosure to the atmosphere.

24. A loudspeaker comprising:

a speaker cone;

a generally annular electrical winding and former therefor defining an interior air chamber and attached to said speaker cone for vibrating the latter, said former having at least one opening therethrough affording communication between said interior air chamber and an exterior chamber about said former;

a generally annular pole piece arranged substantially coaxially of said voice coil and a permanent magnet cooperable with said pole piece for driving said speaker cone in response to an electrical signal applied to said coil;

a speaker frame support about said winding and said former; and a cooling system for the loudspeaker including first and second nozzles for flowing air substantially unidirectionally through said loudspeaker in response to vibratory movement of said speaker cone, each said nozzle having an air inlet, an air outlet and a low-pressure region adjacent said air outlet, aid first nozzle being carried by said speaker frame support and having its low-pressure region opening into said exterior chamber for inducing a flow of cooling air into said exterior chamber and through said one opening in said former for flow into said interior chamber in response to vibratory movement of said speaker cone, said second nozzle including an aerodynamically shaped surface within said pole piece and forming an air gap in communication with said interior chamber, the low-pressure region of said second nozzle being disposed on the side of said surface remote from said interior chamber for inducing a flow of cooling air from said interior chamber through said air gap into said low-pressure region in response to vibratory motion of said speaker.

25. A loudspeaker according to claim 24 including a third nozzle carried by said pole piece in communication with said exterior chamber and a cavity within said pole piece, said third nozzle having an air inlet and an air outlet defining a low-pressure region adjacent said air outlet and located to induce a flow of air between said exterior chamber and said cavity in response to vibratory movement of said speaker cone.

26. A loudspeaker according to claim 25 wherein said low-pressure region of said third nozzle lies on the side of said pole piece remote from said cavity for inducing flow of air from said cavity through said third nozzle and into said exterior chamber.

27. A loudspeaker according to claim 25 wherein said low-pressure region of said third nozzle lies on the side of said pole piece remote from said exterior chamber for inducing flow of air from said interior chamber into said cavity.

28. A loudspeaker according to claim 25 including a plurality of third nozzles carried by said pole piece in communication with said exterior chamber and said cavity, with each third nozzle having an air inlet and an air outlet defining a low-pressure region adjacent said air outlet, one of said low-pressure regions of said third nozzles being located on the side of said third nozzle remote from the cavity for inducing flow of air from said cavity through said third nozzle into said exterior chamber in response to vibratory movement of said speaker cone, another of said low-pressure regions of said third nozzles being located on the side of said nozzle remote from said exterior chamber for inducing flow of air from said exterior chamber into said cavity in response to vibratory movement of said speaker cone.

29. A loudspeaker according to claim 25 wherein the unidirectional flow of cooling air through said speaker is provided solely in response to vibratory movement of said speaker cone.

30. A loudspeaker comprising:

a speaker cone;

a generally annular electrical winding and former therefor defining an interior air chamber and attached to said speaker cone for vibrating the latter, said former having at least one opening therethrough affording communication between said interior air chamber and an exterior chamber about said former;

a generally annular pole piece arranged substantially coaxially of said voice coil and a permanent magnet cooperable with said pole piece for driving said speaker cone in response to an electrical signal applied to said coil;

a speaker frame support about said winding and said former; and a cooling system for the loudspeaker including a nozzle for flowing air substantially unidirectionally through said loudspeaker in response to vibratory movement of said speaker cone, said nozzle having an air inlet, an air outlet and a low-pressure region adjacent said air outlet, said nozzle being carried by said speaker frame support, said low-pressure region being located to induce a flow of air through said exterior chamber and said one opening in said former in response to vibratory movement of said speaker cone.

31. A loudspeaker according to claim 30 including a second nozzle having an aerodynamically shaped surface within said pole piece and forming an air gap in communication with said interior chamber, the low-pressure region of said second nozzle being disposed on one side of said surface for inducing a flow of air through said air gap into said low-pressure region in response to vibratory motion of said speaker.

32. A loudspeaker according to claim 30 including a nozzle carried by said pole piece in communication with said exterior chamber and a cavity within said pole piece, the latter nozzle having an air inlet and an air outlet defining a low-pressure region adjacent said air outlet and located to induce a flow of air between said exterior chamber and said cavity in response to vibratory movement of said speaker cone.

33. A loudspeaker according to claim 31 including a third nozzle carried by said pole piece in communication with said exterior chamber and a cavity within said pole piece, aid third nozzle having an air inlet and an air outlet defining a low-pressure region adjacent said air outlet and located to induce a flow of air between said exterior chamber and said cavity in response to vibratory movement of said speaker cone.

34. A loudspeaker according to claim 33 wherein said first nozzle has its low-pressure region opening into said exterior chamber for inducing a flow of cooling air into said exterior chamber and through said one opening in said former for flow into said interior chamber, said second nozzle having its low-pressure region disposed on the side of said surface remote from said interior chamber for inducing a flow of cooling air from said interior chamber through said air gap into said low-pressure region, said third nozzle having its low-pressure region located on the side thereof remote from said cavity to induce a flow of air from said cavity through said third nozzle into said exterior chamber.

35. A loudspeaker comprising:

a speaker cone;

a generally annular electrical winding and former therefor defining an interior air chamber and attached to said speaker cone for vibrating the latter, said former having at least one opening therethrough affording communication between said interior air chamber and an exterior chamber about said former;

a generally annular pole piece arranged substantially coaxially of said voice coil and a permanent magnet cooperable with said pole piece for driving said speaker cone in response to an electrical signal applied to said coil;

a speaker frame support about said winding and said former; and a cooling system for the loudspeaker including a nozzle for flowing air substantially unidirectionally through said loudspeaker in response to vibratory movement of said speaker cone, said nozzle having an air inlet, an air outlet and a low-pressure region adjacent said air outlet, said nozzle including an aerodynamically shaped surface within said pole piece and forming an air gap in communication with said interior chamber and a cavity in said pole piece on the opposite side of said air gap from said interior chamber, the low-pressure region of said nozzle being disposed on one side of said surface for inducing a flow of air through said air gap and between said interior chamber and said cavity into said low-pressure region in response to vibratory motion of said speaker.

36. A loudspeaker according to claim 35 including a nozzle carried by said pole piece in communication with said exterior chamber and said cavity, the latter nozzle having an air inlet and an air outlet defining a low-pressure region adjacent said air outlet and located to induce a flow of air between said exterior chamber and said cavity in response to vibratory movement of said speaker cone.

37. A loudspeaker according to claim 36 wherein the first mentioned nozzle has its low-pressure region opening into said cavity for inducing a flow of cooling air from said interior chamber and through said air gap for flow into said cavity, the low-pressure region of the nozzle carried by said pole piece lying on the side of said pole piece remote from said cavity for inducing a flow of air from said cavity through the nozzle carried by said pole piece and into said exterior chamber.

38. A loudspeaker comprising:

a speaker cone;

a generally annular electrical winding and former therefor defining an interior air chamber and attached to said speaker cone for vibrating the latter, said former having at least one opening therethrough affording communication between said interior air chamber and an exterior chamber about said former;

a generally annular pole piece arranged substantially coaxially of said voice coil and a permanent magnet cooperable with said pole piece for driving said speaker cone in response to an electrical signal applied to said coil;

a speaker frame support about said winding and said former; and a cooling system for the loudspeaker including a nozzle for flowing air substantially unidirectionally through said loudspeaker in response to vibratory movement of said speaker cone, said nozzle having an air inlet, an air outlet and a low-pressure region adjacent said air outlet, said nozzle being carried by said pole piece in communication with said exterior chamber and a cavity within said pole piece, said nozzle having an air inlet and an air outlet defining a low-pressure region adjacent said air outlet and located to induce a flow of air between said exterior chamber and said cavity in response to vibratory movement of said speaker cone.

39. A loudspeaker according to claim 38 wherein said low-pressure region of said nozzle lies on the side of said pole piece remote from said cavity for inducing a flow of air from said cavity through said nozzle and into said exterior chamber.

40. A loudspeaker according to claim 38 including a plurality of said nozzles carried by said pole piece in communication with said exterior chamber and said cavity, with each said nozzle having an air inlet and an air outlet defining a low-pressure region adjacent said air outlet, one of said low-pressure regions of one of said nozzles being located on the side of said one nozzle remote from the cavity for inducing flow of air from said cavity through said one nozzle into said exterior chamber in response to vibratory movement of said speaker cone, another of said low-pressure regions of another of said nozzles being located on the side of said another nozzle remote from said exterior chamber for inducing flow of air from said exterior chamber into said cavity in response to vibratory movement of said speaker cone.

41. A loudspeaker comprising:

a speaker cone;

a generally annular electrical winding and former therefor defining an interior air chamber and attached to said speaker cone for vibrating the latter;

a generally annular pole piece arranged substantially coaxially of said voice coil and a permanent magnet cooperable with said pole piece for driving said speaker cone in response to an electrical signal applied to said coil;

a cooling system for the loudspeaker including a member having an aerodynamically-shaped surface disposed to define an air gap with said pole piece, said air gap lying in communication with said chamber, said surface being aerodynamically-shaped to define with said pole piece a cavity having an increasing cross-sectional area in a direction away from said gap and thereby defining a low-pressure region for inducing a flow of air between said interior chamber and said cavity in response to vibratory movement of said speaker cone; and a speaker frame having a frame support, a spider connecting said speaker frame and said cone one to the other and defining an exterior chamber about said voice coil former, a plurality of apertures through said former affording communication between said interior and exterior chambers, a passive air pump carried by said frame support including at least one opening through said frame support, aid one frame support opening being larger in cross-sectional dimension on one side thereof than on the opposite side thereof to define a second low-pressure region adjacent the larger dimensioned side of said one frame support opening to induce flow of and thereby pump cooling air unidirectionally between said second low-pressure region and said interior chamber in response to vibratory movement of said speaker cone.

42. A loudspeaker comprising:

a speaker cone;

a generally annular electrical winding and former therefor defining an interior air chamber and attached to said speaker cone for vibrating the latter;

a generally annular pole piece arranged substantially coaxially of said voice coil and a permanent magnet cooperable with said pole piece for driving said speaker cone in response to an electrical signal applied to said coil;

a cooling system for the loudspeaker including a member having an aerodynamically-shaped surface disposed to define an air gap with said pole piece, said air gap lying in communication with said chamber, said surface being aerodynamically-shaped to define with said pole piece a cavity having an increasing cross-sectional area in a direction away from said gap and thereby defining a low-pressure region for inducing a flow of air between said interior chamber and said cavity in response to vibratory movement of said speaker cone;

a speaker frame and a spider connecting said speaker frame and said cone one to the other and defining an exterior chamber about said voice coil former, a passive air pump carried by said pole piece including a plurality of aerodynamically-shaped openings spaced circumferentially one from the other about said pole piece with each opening being larger in cross-sectional dimension on one side of said opening than on the opposite side of said opening to define low-pressure regions on said one side of said pole piece openings for inducing a flow of cooling air through said pole piece openings between said exterior chamber and said cavity in response to vibratory movement of the cone; and said speaker frame having a frame support, said former having a plurality of apertures therethrough affording communication between said interior and exterior chambers, a passive air pump carried by said frame support including at least one opening through said frame support, said one frame support opening being aerodynamically-shaped with a cross-sectional dimension on one side thereof larger than the cross-section of the one frame support opening on the opposite side thereof to define a low-pressure region adjacent said one side of said one frame support opening to induce a flow of and thereby pump cooling air between said low-pressure region defined by said one frame support opening and said interior chamber.

43. A loudspeaker comprising:

a speaker cone;

a generally annular electrical winding and former therefor defining an interior air chamber and attached to said speaker cone for vibrating the latter;

a generally annular pole piece arranged substantially coaxially of said voice coil and a permanent magnet cooperable with said pole piece for driving said speaker cone in response to an electrical signal applied to said coil;

a cooling system for the loudspeaker including a member having an aerodynamically-shaped surface disposed to define an air gap with said pole piece, said air gap lying in communication with said chamber, said surface being aerodynamically-shaped to define with said pole piece a cavity having an increasing cross-sectional area in a direction away from said gap and thereby defining a low-pressure region for inducing a flow of air between said interior chamber and said cavity in response to vibratory movement of said speaker cone;

a speaker frame and a spider connecting said speaker frame and said cone one to the other and defining an exterior chamber about said voice coil former, a passive air pump carried by said pole piece including a plurality of aerodynamically-shaped openings spaced circumferentially one from the other about said pole piece with each opening being larger in cross-sectional dimension on one side of said opening than on the opposite side of said opening to define low-pressure regions on said one side of said pole piece openings for inducing a flow of cooling air through said pole piece openings between said exterior chamber and said cavity in response to vibratory movement of the cone; and a plurality of apertures through said former affording communication between said interior and exterior chambers whereby air flows (i) from said interior chamber through said air gap into said cavity and (ii) through said apertures in said former into said exterior chamber and from said exterior chamber through at least said one opening in said pole piece to cool said coil and said pole piece.

44. A loudspeaker comprising:

a speaker cone;

a generally annular electrical winding and former therefor defining an interior air chamber and attached to said speaker cone for vibrating the latter;

a generally annular pole piece arranged substantially coaxially of said voice coil and a permanent magnet cooperable with said pole piece for driving said speaker cone in response to an electrical signal applied to said coil;

a cooling system for the loudspeaker including a member having an aerodynamically-shaped surface disposed to define an air gap with said pole piece, said air gap lying in communication with said chamber, said surface being aerodynamically-shaped to define with said pole piece a cavity having an increasing cross-sectional area in a direction away from said gap and thereby defining a low-pressure region for inducing a flow of air between said interior chamber and said cavity in response to vibratory movement of said speaker cone; and an enclosure for said speaker, said enclosure having a pair of vents for exchanging air within said enclosure and ambient air outside said enclosure, one of said vents including a member having an aerodynamically-shaped surface defining a region of increasing cross-sectional area in the direction of air flow entering said enclosure, the other of said vents including a member having an aerodynamically-shaped surface defining a region of increasing cross-sectional area in the direction of air flow exhausting from said enclosure to ambient air whereby said intake and exhaust vents serve to exchange air in said enclosure and ambient air in response to vibratory movement of said speaker cone.

45. A loudspeaker comprising:

a speaker cone;

a generally annular voice coil and former therefor defining an interior air chamber and attached to said speaker cone for vibrating the latter;

a generally annular pole piece arranged substantially coaxially of said voice coil and a permanent magnet, said pole piece and permanent magnet defining a gap for receiving said voice coil therebetween, said permanent magnet being cooperable with said pole piece for driving said speaker cone in response to an electrical signal applied to said coil, said pole piece having an internal cavity;

a cooling system for said loudspeaker including a speaker frame and a spider connecting said speaker frame and said cone one to the other and defining an exterior chamber about said voice coil former, a passive air pump carried by said pole piece including a plurality of aerodynamically-shaped openings spaced circumferentially one from the other about said pole piece affording communication between said exterior chamber and said cavity through said voice coil gap, said aerodynamically-shaped openings being larger in cross-sectional dimension on one side of said pole piece than on the opposite side of said pole piece providing a low-pressure region on said one side thereof for inducing a flow of cooling air between said cavity and said exterior chamber in response to vibratory movement of said cone; and an enclosure for said speaker, said enclosure having a pair of vents for exchanging air within said enclosure and ambient air outside said enclosure, one of said vents including a member having an aerodynamically-shaped surface defining a region of increasing cross-sectional area in the direction of air flow entering said enclosure, the other of said vents including a member having an aerodynamically-shaped surface defining a region of increasing cross-sectional area in the direction of air flow exhausting from said enclosure to ambient air whereby said intake and exhaust vents serve to exchange air in said enclosure and ambient air in response to vibratory movement of said speaker cone.

46. A loudspeaker comprising:

an enclosure;

a speaker cone mounted in said enclosure;

means for driving said speaker cone to produce audible sound waves;

a cooling system for the loudspeaker system including at least one vent for exchanging air within said enclosure and ambient air outside said enclosure, said one vent including a member having an aerodynamically-shaped surface defining a region of increasing cross-sectional area and a low pressure region for inducing air flow through said one vent and between said enclosure and ambient air in response to vibratory movement of said speaker cone; and an enclosure for said speaker, said enclosure having a pair of vents for exchanging air within said enclosure and ambient air outside said enclosure, one of said vents including a member having an aerodynamically-shaped surface defining a region of increasing cross-sectional area in the direction of air flow entering said enclosure, the other of said vents including a member having an aerodynamically-shaped surface defining a region of increasing cross-sectional area in the direction of air flow exhausting from said enclosure to ambient air whereby said intake and exhaust vents serve to exchange air in said enclosure and ambient air in response to vibratory movement of said speaker cone.

* * * * *